United States Patent [19]

Schneider et al.

[11] 4,200,246

[45] Apr. 29, 1980

[54] CONVEYOR DEVICE FOR A THIN WEB AND A METHOD OF CONVEYING

[75] Inventors: Bruno Schneider, Renens; Fritz Nigg, Bissigny; Jean-Claude Risse, Prangins, all of Switzerland

[73] Assignee: J. Bobst & Fils, S.A., Lausanne, Switzerland

[21] Appl. No.: 895,113

[22] Filed: Apr. 10, 1978

[30] Foreign Application Priority Data

Apr. 14, 1977 [CH] Switzerland ..... 4617/77

[51] Int. Cl.[2] ..... B65H 17/02

[52] U.S. Cl. ..... 242/67.4; 226/18; 242/57.1

[58] Field of Search ..... 242/67.4, 67.3 R, 75.51, 242/57.1, 203, 205, 71.1; 226/18, 19, 21, 20, 23, 55, 67.1 R, 67.2

[56] References Cited

U.S. PATENT DOCUMENTS

| | | | |
|---|---|---|---|
| 3,503,678 | 3/1970 | Ludwig | 242/57.1 X |
| 3,630,469 | 12/1971 | Turgeon | 242/67.4 X |
| 3,765,586 | 10/1973 | Floden | 226/84 |
| 3,769,885 | 11/1973 | Linde | 95/4.5 |
| 3,857,525 | 12/1974 | Gerber et al. | 242/57.1 |

*Primary Examiner*—George F. Mautz

*Attorney, Agent, or Firm*—Hill, Van Santen, Steadman, Chiara & Simpson

[57] ABSTRACT

An improved conveying device for conveying a thin web through a station in both directions with the desired registry characterized by a supply device for storing a reel of the thin web, a guiding device for guiding the thin web through the station and a take up or receiving device for rewinding the web with the take up or receiving device and the driving means being controlled so that the take up device does not apply any tension to the web at the station. In order to determine the exact amount of the web passing through the station a meter or measuring device is utilized and to ensure proper alignment of the web, the guiding means includes rollers continually holding the edge of the web against a lateral guide member. Due to the control and the use of the meter device, the web may be moved back and forth through the station to allow processing laterally offset portions of the web and maintain the registry between the various laterally offset portions.

10 Claims, 9 Drawing Figures

CONVEYOR DEVICE FOR A THIN WEB AND A METHOD OF CONVEYING

BACKGROUND OF THE INVENTION

1. Field of the Invention

The present invention is directed to a conveyor device for conveying a thin web such as a film or photographic paper within a station of a phototype setting machine and the method of conveying.

2. Prior Art

Presently known thin film conveying systems, which are used with phototype setting machines, are generally made in such a way as to enable unrolling a certain amount of film from a supply reel, passing it through an exposing window and then rewinding it on a take up reel after the exposure of the film. In front of the exposure window, the film is guided by upper and lower plates or platens which use the principles that are usually the same as the ones adopted for most cameras. The unwinding or supply reel is supported in such a way as to be able to rotate freely on its axis; however, any axial shift is impossible on account of the arrangement and design of the axle bearings of the unwinding or supply reel. The rewinding or take up reel is equally supported between two bearings and cannot undergo any axial shift. The drive for advancing the web is conceived so that when the leader of the film has been seized by a pair of pinchers or other fastening devices, the film will be wound on the take up reel after each exposure. This type of conveyance device necessitates a perfect alignment of both the supply and take up reels, a constant web width, and adequate web tension as well as step-by-step control of the take up reel drive motor.

Other types of devices use both storage or supply cassettes and take up or rewinding cassettes which are free to rotate on their axis. The web drive is obtained by means of an upper roller operating jointly with a lower roller with one of the two rollers being driven by a stepping motor.

Conveyor devices of these types or kind enable a film to be shifted in both directions, i.e. forward and backward, through an exposure station. Such an operation is necessary on account of the fact that after the exposure of several text lines, it is often useful to be able to step back for the purpose such as paging, structuring of adjacent text columns, or composing a table.

The principle use for the conveyance of film as well as the conveyors described above are likely to impair accurate registration between the various lines or exposed signs. In fact, supposing that a column of thirty lines has been composed on the right hand side of a film and that a second column of the same dimension is to be arranged on the left hand side, it is necessary to pull back the film by a distance corresponding to the length of the first column, shift either the film or the character projection device sideways and to expose the new or second column line-by-line.

In the known devices, an undersirable shift takes place between the line alignment of one of the columns with regard to the other column. Differences due to such shifts are caused by the fact that the film pulled out from the supply cassette is tensioned and hence, stretched during composition of the first column. When the step back or reverse movement of the film for composing the second column occurs, the film is compressed and hence, shortened with regard to the length originally withdrawn from the supply cassette. These two effects do not neutralize each other and, for example, when tables with frames or borders and vertical lines as well as horizontal lines are being composed, the effects will cause imperfections such as unparallel lines, not fully shaped frames or borders, character lines deleted instead of underlined, and other defects. Similar imperfections will also show up if the web slides or slips on the drive means.

SUMMARY OF THE INVENTION

The present invention is directed to a conveyor device with which alignment defaults appearing in thin webs, for instance in a film or photographic paper traveling passed an exposure station, will be minimized or removed.

In order to accomplish these tasks, the present invention is directed to an improvement in a conveyor device for conveying a thin web through a station in both directions with the desired registry with the device including a supply means for storing a thin web, guide means for guiding the thin web after it is removed from the supply means and transporting it through the station, and receiving means for taking up the web after it is passed through the guide means. The improvements comprise the supply means consisting of a cassette with a free rotating reel upon which the web can be wound, and means for supporting said cassette on the frame of the device for movement in a direction transverse to the direction of movement of the web; said receiving means including a take up reel for winding up the web discharge from the guide means including drive means for rotating the take up reel; and said guide means including an upper plate and a lower platen for receiving the web therebetween with a side guide member, means for continuously holding the edge of the web in contact with the side guide member, drive means for driving the web through the guide means including lower and upper rollers and a motor rotating one of said rollers, said upper plate and lower platen having apertures to enable said rollers and means for holding to engage the web, meter means for measuring the amount of the web passing a given point, control means having a memory for recording data from the meter means and for controlling the speed of the motor for the drive rollers and the motor for the receiving means so that a desired slack is maintained in the web as it is received in the receiving means to prevent tensioning a portion of the web in the guide means.

The method of conveying the web through a station in both directions comprises the steps of unwinding a thin web from a supply means for storing the thin web, conveying the web through a guide means for guiding the thin web after it s removed from the supply means and for transporting it through the station, transporting the web and continually holding an edge of the web in contact with a side guide member, measuring the amount of web moved passed a given point and recording the amount measured, utilizing the recorded amount to control the amount of advance of the web, winding the web leaving the device on a take up reel while maintaining the slack therein so that the winding does not aply a tension on the web at the station. Preferably, the methods include reversing the direction of movement of the web through the station for a given amount dependent upon a previously recorded measured amount to enable processing adjacent lateral offset strips on the web with the step of reversing including disengaging the drive for the take up reel.

Preferably, the means for supporting the cassette includes a pair of rails extending transverse to the direction of movement of the web through the device, a frame supporting the cassette having rollers engaging said rails to that the cassette can be shifted transverse to the direction of movement. The means for continuously holding the edge of the web in contact with the side guide includes at least on pair of rollers mounted adjacent the side guide member, one of said rollers being mounted in a self-aligning bearing so that the axis of rotation of the roller pivots about a point to maintain the edge of the web on the side guide member, and the one roller includes means for pivoting the axis of roller in the self-adjusting bearing to vary the pressure applied by the roller on the web.

In order for the web to be moved in both directions, at least the drive motor for the drive means is reversible and the drive motor for the take up reel is either reversible or connected by a clutch so that as the web is being moved in a reverse direction, the meter means and the control means ensures proper registry of the web as it is moved in either of the two directions.

DESCRIPTION OF THE PREFERRED EMBODIMENTS

Figure 1:
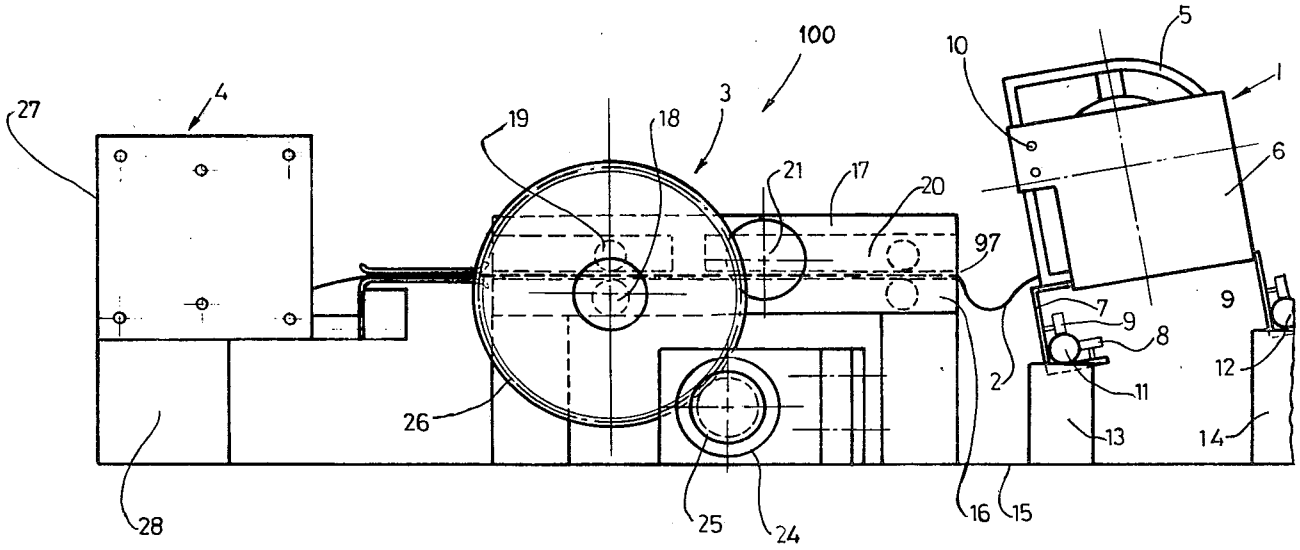
FIG. 1 is a schematic side view of a conveyor device in accordance with the present invention.
Figure 2:
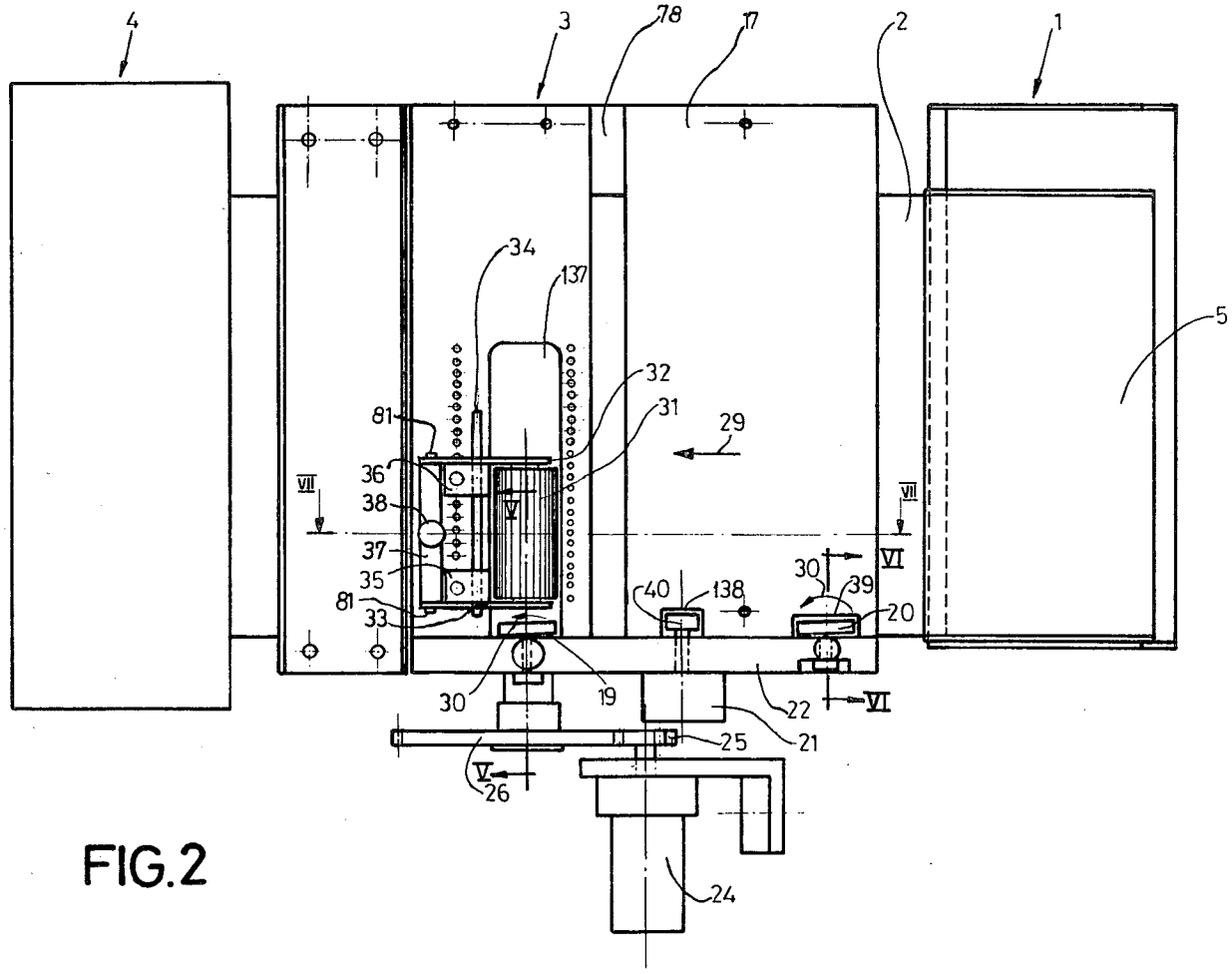
FIG. 2 is a plan view of the device of FIG. 1.

The principles of the present invention are particularly useful in a conveyor device generally indicated at 100 in FIGS. 1 and 2. The device 100 has a supply means generally indicated at 1 for providing a thin web 2, guide means generally indicated at 3 for receiving the thin web and transporting it passed a station to a receiving means generally indicated at 4 which rewinds the web 2.

The supply means 1 includes a cassette 5 arranged in a frame 6 which has a base 7. The base 7 is provided with rollers 8 and 9, which engage rails 11 and 12 that are secured on columns 13 and 14, which extend from a frame member 15 of a machine such as a phototype setting machine which is not illustrated.

From the supply means 1, the web 2 is fed through the guide means 3, which has a lower platen 16 across which the web 2 travels. The platen 16 along with other elements contacting the web 2 are preferably made of a material, which is electrically conductive so that problems from static electricity can be disregarded. In order to keep the thin web in a perfectly flat position on the platen 16, an upper plate 17 is provided in overlying relationship thereto. Both the upper plate 17 and the lower platen 16 have been arranged in such a way so as to allow the operation of a drive means 18 and pressure devices 19 and 20 for the thin web 2. A meter means 21 for measuring the amount of the thin web 2 passing between the lower platen 16 and the upper plate 17 is positioned on a side guide member 22 as best illustrated in FIG. 2. In addition to the meter means, the driving means 18 as well as the pressure applying means 19 and 20 are also supported on th side guide member 22. A lower roller 23 (FIG. 7) of the driving means 18 is rotated by a motor 24 (FIG. 2) which drives a pinion gear 25 that is in meshing relationship with a gear 26 attached to the shaft of the roller 23.

The receiving means 4 as illustrated in FIG. 1 has a housing 27, which is secured on the frame 15 of the phototype setting device by means of a support such as 28.

Figure 9:
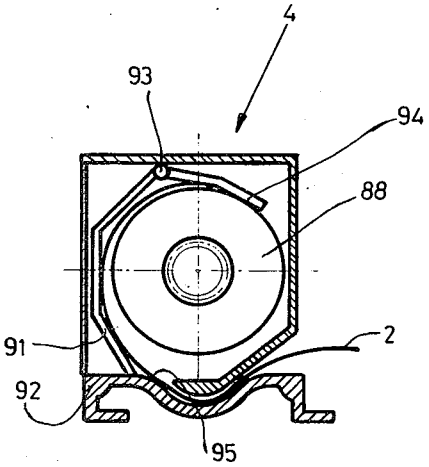
FIG. 9 is a cross-sectional view taken along lines IX—IX of FIG. 8.

As best illustrated in FIG. 2, the thin web 2 is shown as being unwound from a cassette 5 in the direction of arrow 29. If, for any reason, the thin web 2 should have a tendency to move from engagement with the side guide member 22, pressure devices 19 and 20 will automatically pivot in the direction of arrows 30 and thus urge the edge of the thin web back into engagement with the side guide member 22. Thus, a continual guiding pressure is actually applied to the thin web to maintain its edge in contact with the guide member 22 and this pressure is only obtainable if the web 2 has an adequate slack after passing the guide means 3 and prior to being wound on the receiving means 4, and if the web 2 is unwound from a displaceable cassette 5. The adequate slack, which is available after leaving the guide means 3, is achieved by having the web 2 provided with a loop in the receiving means 4 as best illustrated in FIG. 9.

In addition to rollers for the pressing means 19 and 20, an upper drive roller 31 of the drive device 18 is illustrated in FIG. 2. The upper drive roller 31 is supported on levers 32, 33, which pivot around a commond axis 34. The axis 34 is held by two bearings 35 and 36 and are interconnected by a stirrup 37, the center of which receives the device 38 for adjusting the pressure of the upper drive roller 31 on the web 2. The assembly made up of the upper drive roller 31, levers 32 and 33 as well as the bearings 35 and 36 is shiftable sidewise so that the best possible traveling position for the thin web can be chosen. The upper plate 17 is provided with apertures 137, 138 and 39 to enable the rollers of pressure device 19, the upper roller 31, the roller 40 of the metering means 21 and the pressure roller 20 to engage the upper surface of the web 2. In addition, the upper plate 17 has a transverse extending slot 78 which forms an aperture for the web to be exposed through.

Figure 3:
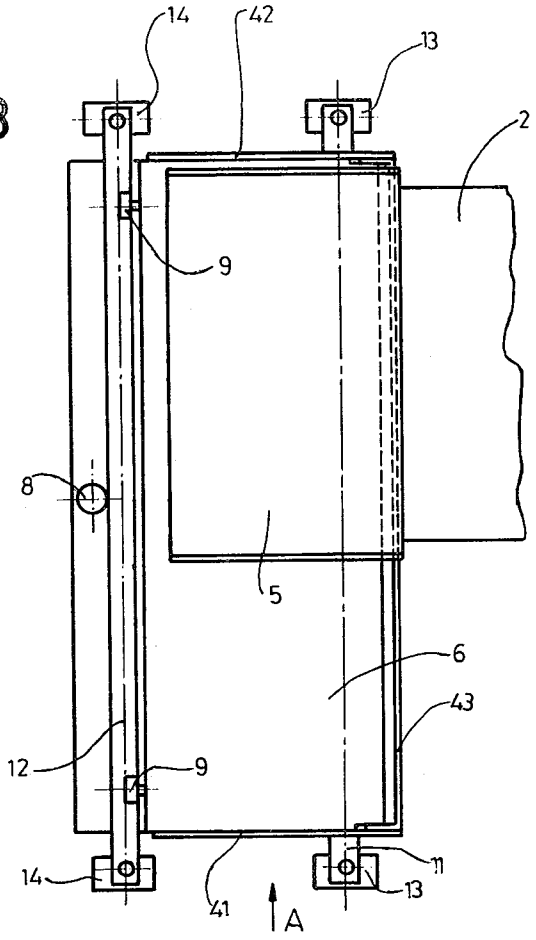
FIG. 3 is a top view of the supply means of the device of FIGS. 1 and 2.
Figure 4:
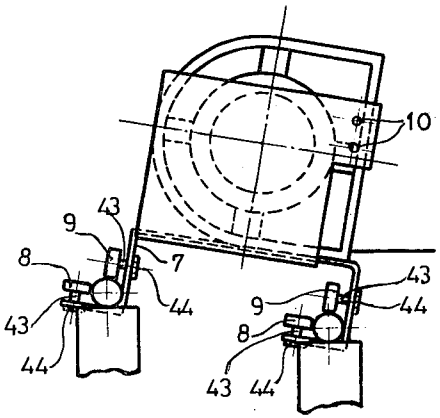
FIG. 4 is an end view taken from the direction of arrow A in FIG. 3.

As mentioned hereinbefore, the web 2 is taken from a supply reel which is in the form of a cassette 5 which is mounted by means enabling transverse movement to the direction of feed of the web 2. As it is best illustrated in FIGS. 3 and 4, the frame 6 which receives the cassette 5 consists of two side guides or members 41 and 42, which are connected by crossbar 43, which is arranged to the side guides or members 41 and 42 by rivets 10 (FIGS. 1 and 4). The side guides 41 and 42 are attached to the base 7. As best illustrated in FIG. 4, each of the rollers 8 and 9 are supported for rotation on shafts 43 which are held on the base 7 by nuts 44 so that the frame 6 along with the cassette 5 can move in a transverse direction which would be direction A in FIG. 3.

Figure 5:
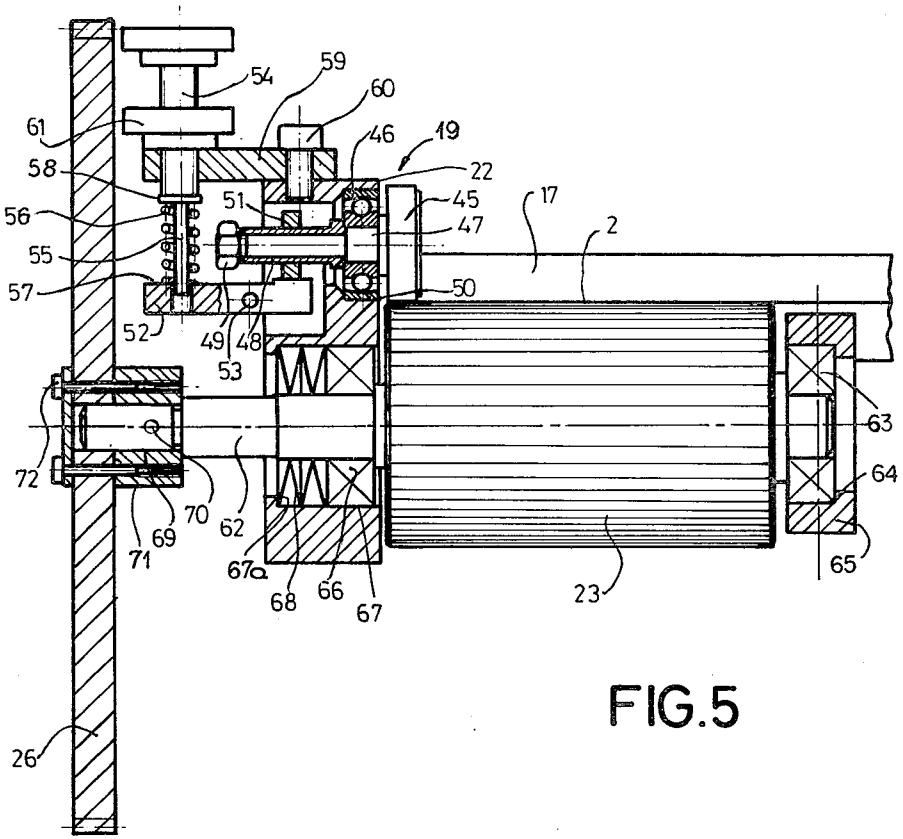
FIG. 5 is a cross-sectional view with portions removed for purposes of illustration taken along lines V—V of FIG. 2.
Figure 6:
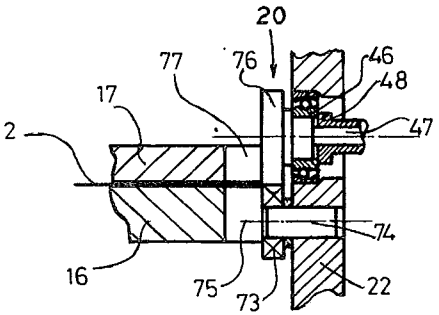
FIG. 6 is a cross-sectional view taken along lines VI—VI of FIG. 2.

A pressure device such as 19 for holding the edge of the web 2 continuously against the side guide member 22 is best illustrated in FIG. 5 and a similar pressure roller arrangement 20 is illustrated in FIG. 6. The device 19 consists of a rubber roller 45, which has been provided with an anti-static treatment and cooperates with the lower roller 23, which is part of the drive means 18 for advancing the web 2. A self-aligning bearing 46 supports an axle 47 of the roller 45 in the member 22 and its axle 47 is held in position in the bearing 46 by means of a cross piece 48 and a nut 49. The outer ring or race of the self-aligning bearing 46 is received in a bore 50, which is in side guide member 22. The cross piece 48 has an annular flange 51, which engages one end of a lever 52 that is mounted for pivotal movement on an axle 53. The lever 52 at an opposite end has a guiding bore, which receives the end 55 of a set screw 54. The end 55 of the set screw 54 is provided with a compression spring 56, which acts between a face 57 of the lever 52 and a washer 58, which is secured at the set screw 54 so that threading of the set screw 54 into a tapped section of a support 59, which is secured by screws 60 on the guide member 22, causes a changing of the pressure acting on the lever to change the pressure exerted by the roller 45 on the web 2. When a desired setting for the set screw 54 is obtained, the set screw may be locked by use of a knurled knob 61.

Figure 7:
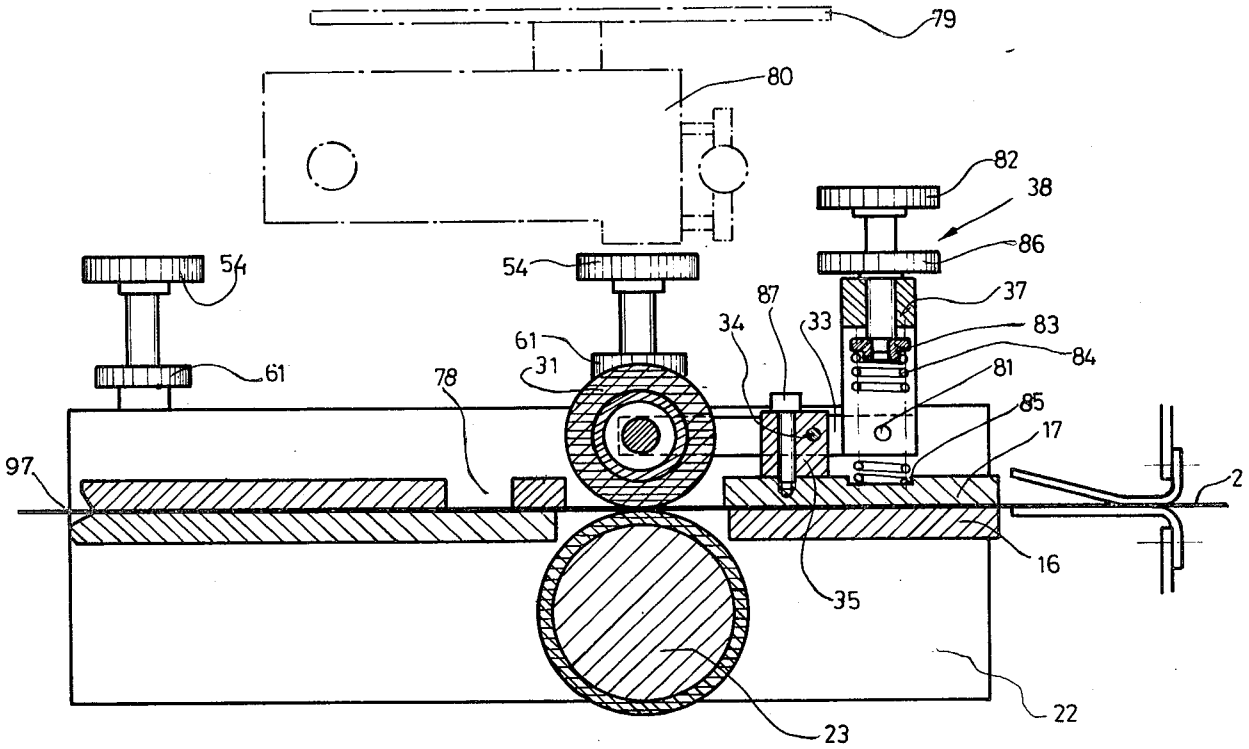
FIG. 7 is a cross-sectional view taken along lines VII—VII of FIG. 2.

The lower roller 23 of the drive means 18 is also provided with an anti-static rubber coating (see FIG. 7). The lower roller 23 has an axle 62 (FIG. 5) having one end provided with a roller bearing 63 received in a bore 64 of a bearing support 65 which is secured on the platen 16 by means of screws which are not illustrated. The other end of the axle 62 is equipped with a ball bearing 66 received in a bore 67 in the side guide member 22. A lateral backlash of the lower roller 23 is prevented by spring washers 68, which are also received in the bore 67 between a shoulder 67*a* and the bearings 66. The axle 62 has a part or portion 69, which receives a hub 71 of a tooth wheel or gear 26 that is secured thereto by a pin 70. The tooth wheel 26 is connected to the hub 71 by means of screws 72.

The pressure means 20, which also continuously holds an edge of the thin web 2 on the side guide member 22, consists of a lower roller 73, which includes a ball bearing and is secured on the end of an axle 74 that is mounted in the side guide member 22. The axle 74 may be secured by any means such as by glue within the bore of the side guide 22. Platen 16 has an aperture 75 which enables the roller 73 to extend therethrough into engagement with the web 2 and an upper roller 76 extends through an aperture 77 in the upper plate 17. The upper roller 76 is supported on a shaft similar to the shaft or axle 47 in a self-adjusting bearing such as 46, which is the same as that used in the device 19.

As best illustrated in FIG. 7, the thin web 2, when removed from the cassette 5 is introduced between the platen 16 and the upper plate 17. As illustrated in FIGS. 7 and 2, the upper plate has an aperture 78, which extends the full width and allows the exposure of characters or lines from a character bearing disk 79 of a photographic unit 80 shown in broken lines. The pressure exerted by the upper drive roller 31 on the web 2 is adjustable by means of a device genrally indicated at 38. This device includes the strap 37 which connects the two levers 32 and 33 by means of two studs or fasteners 81. The upper part of the strap 37 contains a set screw 82, which has an end that is provided with a seat 83 that acts on one end of a compression spring 84 whose other end is engaged in a recess 85 in the upper plate 17. The set screw 82 can be locked by means of a knurled knob 86 when the desired compression on the spring 84 is obtained. The levers 32 and 33 pivot about the axis 34, which is supported in blocks such as 35 and 36 on the upper plate 17 by means of screws such as 87.

Figure 8:
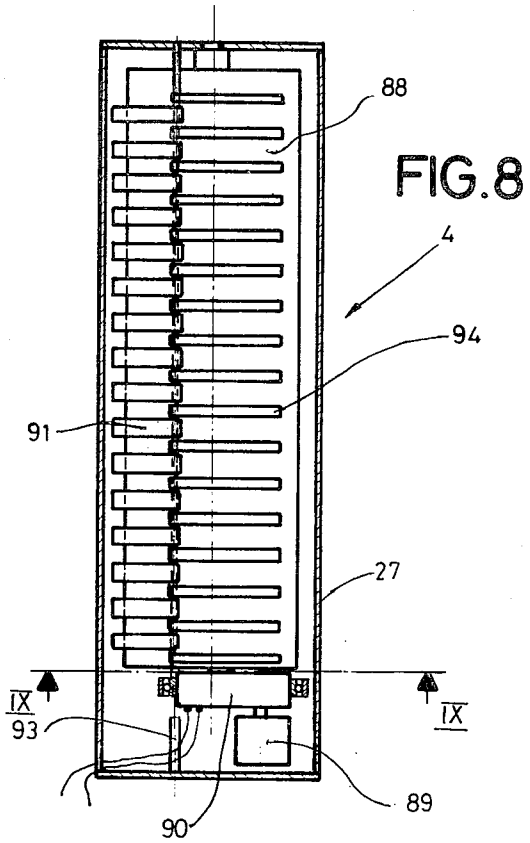
FIG. 8 is a cross-sectional view with portions in elevation for the take up means of FIG. 2.

The receiving means 4 as mentioned above has a housing 27 which contains a take up reel 88 (FIGS. 8 and 9). The reel 88 is supported on one end by a bearing mounted in an end of the housing 27 and the other end of the reel 88 is provided with a drive device, which includes a motor 89 and an electromagnetic clutch 90. The motor 89 is connected to the reel 88 and the electromagnetic clutch 90 by means of pinions (not illustrated). The housing or box 27 can also contain an assembly of guides 91, which are fixed to a base 92 (FIG. 9), and are pivotally connected by an axle 93 to a plurality of fingers 94, which are designed to ensure the taking on and the winding up of the thin web 2 onto the reel 88.

As best illustrated in FIG. 9, the web 2 as it is received in the housing is provided with a loop 95 to ensure the desired slack and to also ensure that the take up reel 88 does not apply any tension on the web 2 at the station such as at the opening or slot 78.

In operation of the device 100, the thin web 2 is unrolled from the supply means 1 and introduced into the guide means 3. The loop 95 is provided at the receiving means 4 so that the web does not have any tension applied thereto by the take up reel 88 and thus cause any undesirable stretching of the web. If, during an operation, the web 2 shifts sideways, for instance under influence of a unilateral friction, the sideways shift is prevented by means of the pressure units 19 and 20 holding the edge of the web 2 against the side guide member 22. Thus, any lateral shifting acts on the pressure devices 19 and 20 to cause a pivoting due to the self-aligning bearing 46 to increase the pressure holding the web against the side guide member 22 to counteract any lateral shifting force. The web 2 can be carried either in the direction of the arrow 29 or backwards in an opposite direction in accordance to the desired requirements of the machine such as the phototype setting device. To this aim, the user will only have to reverse the direction of rotation of the motor 24 driving the lower roller 23 as well as the motor 89 driving the reel 88 of the receiving means 4. When the thin web 2 travels opposite to the direction 29, it will cause a loop to be formed at an inlet 97 (FIG. 1) of the guide means 3 adjacent the storage means 1.

In order to make sure the loop 95 is actually formed within the receiving means 4, the electromagnetic clutch 90 is used for driving the reel 88. The reel 88, however, is only driven when the thin web 2 has been moved forward or backward a specific length by the drive unit 18. An electronic device, which is not illustrated, records the movement of the thin web and causes both motors 24 and the electromagnetic clutch 90 to be switched on so that the loop 95 will be maintained when the thin web moves. All moves of the thin web 2 are recorded during a composition of an image on the web and are transmitted to a memory. Thus, when the web 2 travels in a reverse direction, the information concerning the shift to be carried out is transmitted from the memory to the control circuit of the motor 24 of the drive unit 18 and, therefore, in order to repress any inaccuracies due to slipping of the drive means 18, the meter means 21 checks or measures the amount of travel of the thin web and transmits this amount to the control circuit of the motor 24. The motor 24 will then only come to a standstill when the information provided by the meter means 21 corresponds to the data recorded in the memory. In such a way, slipping of the web 2 in the drive means 18 during movement in either one of the two directions will always be compensated for so that the web is moved the same distance or amount in each direction.

The thin web will be driven sequentially when composition takes place. If, for instance, the composition of a page with several columns with separate vertical and horizontal lines is considered, the thin web is driven sequentially through the composition of the column situated, for instance, on the right hand side of the page. At the end of the formation of this first column, the thin web will be moved back over a distance corresponding to the length of the first column. Then the conveyor device will be moved the web in such a way as to compose a second new column beside the preceeding column. This procedure is continued until the whole page has been composed. Horizontal lines are made by moving the thin web 2 into the desired position within the aperture or slot 78 and by continuously moving the photographic unit 80 along the slot. Vertical lines are obtained by continuously moving the thin web 2 in front of the photographic unit 80 which is held in a fixed position above the slot 78.

The use of the above described conveyor device 100 allows the movement of the thin web 2 in both a forward and backward direction will full accuracy or registration between the various lines of characters formed in various columns. The advantages obtained with this improved registration is that the lines of characters of two columns situated side-by-side will be perfectly aligned and also that in the event of a table which is to be composed of geometrical forms such as a rectangular shape, the table will not be changed or displaced with regard to the characters exposed in the web.

Although various minor modifications may be suggested by those skilled in the art, it should be understood that we wish to embody within the scope of the patent warranted hereon, all such modifications as reasonably and properly come within the scope of our contribution to the art.

We claim:

1. In a conveyor device for conveying a thin web through a station in both directions with a desired registry, said device including a supply means for storing a thin web, guide means for guiding the thin web after it is removed from the supply means and transporting it through the station, and receiving means for taking up the thin web after it has passed through the guide means, the improvements comprising the supply means including a cassette with a free rotating reel upon which the web can be wound, means for supporting said cassette on the frame of the device for movement in a direction transverse to the direction of movement of the web; said receiving means including a take up reel for winding up the web discharged from the guide means and including drive means for rotating the take up reel, and said guide means including an upper plate and lower platen for receiving the web with a side guide member, means for continuously holding an edge of the web in contact with the side guide member, drive means for moving the web through the guide means including lower and upper rollers and a motor rotating one of said rollers, said upper plate and lower platen having apertures to enable said rollers and means for holding to engage the web, meter means for measuring the amount of web passing a given point, control means having a memory for recording data from the meter means and for controlling the speed of the motor for the drive rollers and the motor of the receiving means so that a desired slack is maintained in the web as it is received in the receiving means to prevent tensoning the portion of the web in the guide means.

2. In a conveyor device according to claim 1, wherein the means for supporting the cassette includes a pair of rails extending transverse to the direction of movement of the web through the device, a frame supporting said cassette having rollers engaging said rails so that said cassette can be shifted transverse to the direction of movement of said web.

3. In a conveyor device according to claim 1, wherein the means for continuously holding an edge of the web in contact with the side guide member includes at least one pair of rollers mounted adjacent the side guide member, one of said rollers being mounted in a self-aligning bearing so that axis of rotation of the roller pivots about a point to maintain the edge of the web on the side guide member.

4. In a conveyor device according to claim 3, wherein said one roller includes means for pivoting the axis of said roller in the self-adjusting bearing to vary the pressure applied by the roller on the web passing between said pair of rollers.

5. In a conveyor device according to claim 1, wherein at least one of the upper and lower rollers of the drive means includes means for adjusting the pressure applied on the web passing therebetween.

6. In a conveyor device according to claim 1, wherein the drive motor for the drive means as well as the drive motor for the take up reel are reversible so that a portion of the web may be transported both forward and backward through a station and wherein said meter means and said control means ensure proper registry of the web as it is moved in either of the two directions.

7. In a conveyor device according to claim 1, wherein said receiving means includes guide means pivotally supporting guide fingers for guiding the web as it is wound on the take up reel.

8. In a conveyor device according to claim 1, wherein said drive means for rotating the take up reel includes a drive motor and an electromagnetic clutch so that the drive motor can be detachably connected from said take up reel during portions of the movement of the web through the device.

9. A method of conveying a thin web through a station in both directions with the desired registry comprising the steps of unwinding a thin web from a supply means for storing the thin web and allowing the supply means to move transverse to the direction of unwinding, conveying the web through a guide means for guiding the thin web after it is removed from the supply means and for transporting it through the station, transporting the web and continually holding an edge of the web in contact with a side guide member, measuring the amount of web moved passed a given point and recording the amount measured, utilizing the recorded amount to control the amount of advance of the web until a given length of web based on the data recorded from the amount measured, and winding the web leaving the station on a take up reel while maintaining a slack therein so that the winding up does not apply a tension on the web at said station.

10. A method according to claim 9, which includes reversing the direction of movement of the web through the station for a given amount dependent upon a previously recorded measured amount to enable processing an adjacent laterally offset strip on said web, said step of reversing including disengaging the drive for the take up reel.

* * * * *